United States Patent [19]

Kamath et al.

[11] Patent Number: 4,764,664

[45] Date of Patent: Aug. 16, 1988

[54] ELECTRICAL DEVICES COMPRISING CONDUCTIVE POLYMER COMPOSITIONS

[75] Inventors: Hundi P. Kamath, Foster City; Jeffrey C. Leder, Redwood City, both of Calif.

[73] Assignee: Raychem Corporation, Menlo Park, Calif.

[21] Appl. No.: 799,291

[22] Filed: Nov. 20, 1985

Related U.S. Application Data

[60] Continuation of Ser. No. 545,723, Oct. 26, 1983, abandoned, which is a division of Ser. No. 251,910, Mar. 27, 1979, Pat. No. 4,426,339, which is a continuation of Ser. No. 24,369, Mar. 27, 1979, abandoned, which is a continuation of Ser. No. 750,149, Dec. 13, 1976, abandoned.

[51] Int. Cl.[4] ..... H05B 3/10

[52] U.S. Cl. ..... 219/548; 219/528; 219/549; 338/22 R

[58] Field of Search ..... 219/528, 548, 535, 543, 219/549, 553; 338/22 R, 225 D, 211, 212, 214; 264/22, 27, 174, 104, 105, 272, 255, DIG. 65; 29/611; 174/105, 102 SC, 120 SR, 102 R, 72 R; 252/511

[56] References Cited

U.S. PATENT DOCUMENTS

| | | | |
|---|---|---|---|
| 2,978,665 | 4/1961 | Vernet | 338/223 |
| 3,243,753 | 3/1966 | Kohler | 338/31 |
| 3,311,862 | 3/1967 | Rees | 219/543 X |
| 3,342,753 | 9/1967 | Wada | 252/511 |
| 3,344,385 | 9/1967 | Bartos et al. | 338/212 |
| 3,352,958 | 11/1967 | Andrews | 264/272 X |
| 3,387,248 | 6/1968 | Rees . | |
| 3,410,984 | 5/1966 | Sandford et al. | 219/212 |
| 3,412,358 | 11/1968 | Hummel | 338/7 |
| 3,503,823 | 3/1970 | Richart et al. | 156/244 |
| 3,617,695 | 11/1971 | Meyer | 219/222 |
| 3,642,532 | 2/1972 | Greene | 117/233 |
| 3,673,121 | 6/1972 | Meyer | 252/511 |
| 3,676,925 | 7/1972 | Sato et al. . | |
| 3,760,495 | 9/1973 | Meyer | 29/610 |
| 3,793,716 | 2/1974 | Smith-Johannsen | 29/611 |
| 3,823,217 | 7/1974 | Kampe | 264/105 |
| 3,829,545 | 8/1974 | Vlgenderen | 264/174 |
| 3,858,144 | 12/1974 | Bedard et al. | 338/22 R |
| 3,861,029 | 1/1975 | Smith-Johannsen et al. | 29/611 |
| 3,862,056 | 1/1975 | Hartmann | 252/511 |
| 3,878,362 | 4/1975 | Stinger | 219/528 |
| 3,914,363 | 10/1975 | Bedard et al. | 264/105 |
| 3,925,597 | 12/1975 | Misiura | 264/174 X |
| 3,928,519 | 12/1975 | Kashiyama | 264/174 X |
| 3,941,866 | 3/1976 | Ingraham | 264/174 X |
| 3,971,610 | 7/1976 | Buchoff . | |
| 4,055,526 | 10/1977 | Kiyokawa et al. | 219/528 X |
| 4,066,840 | 1/1978 | Allgaier . | |
| 4,151,238 | 4/1979 | Ziemek et al. | 264/DIG. 65 X |
| 4,177,376 | 12/1979 | Horsma et al. . | |
| 4,177,446 | 12/1979 | Diaz | 338/212 |
| 4,188,276 | 2/1980 | Lyons et al. | 252/502 |
| 4,200,973 | 5/1980 | Farkas | 29/611 |
| 4,204,086 | 5/1980 | Suzuki | 264/174 X |
| 4,277,673 | 7/1981 | Kelly | 219/528 |
| 4,286,376 | 9/1981 | Smith-Johannsen et al. | 338/214 X |
| 4,304,987 | 12/1981 | van Konynenburg | 219/553 |
| 4,330,703 | 5/1982 | Horsma et al. | 219/553 |
| 4,334,148 | 6/1982 | Kampe | 219/553 |
| 4,421,582 | 12/1983 | Horsma | 156/86 |
| 4,444,708 | 4/1984 | Gale | 264/105 |

FOREIGN PATENT DOCUMENTS

| | | | |
|---|---|---|---|
| 43-16935 | 5/1968 | Japan . | |
| 46-2632 | 11/1971 | Japan . | |
| 47-46136 | 7/1972 | Japan . | |
| 48-32014 | 7/1973 | Japan . | |
| 50-128845 | 2/1975 | Japan . | |
| 50-128844 | 5/1975 | Japan . | |
| 399780 | 2/1978 | Sweden . | |
| 828334 | of 0000 | United Kingdom . | |
| 1077207 | 7/1967 | United Kingdom | 264/174 |
| 1112274 | 5/1968 | United Kingdom | 264/174 |
| 1167551 | 10/1968 | United Kingdom | 264/174 |
| 1369210 | 10/1974 | United Kingdom | 264/174 |
| 1449539 | 9/1976 | United Kingdom | 264/174 |

OTHER PUBLICATIONS

Plastics Extrusion Technology, by Allan L. Griff, pp. 197, 198 of 208.

Proceedings of the 13th International Wire & Cable Symposium, by Cox, pp. 307–327.

Wire, by Lowe et al, Jul. 1960, pp. 862–865.

Wire, by Parker Stiles, Feb. 1963, pp. 222–224 and 274.

Wire, by Skewis, Oct. 1961, pp. 1338–1344 and 1468–1469.

Plastics Technology, by McNally, Jan. 1967, pp. 41–43.

Dummer, G. W. A., "Materials for Conductive & Resistive Functions", (1970), Sections 4.13, 7.3 to 7.6, 11.1, 12.8 to 12.10, and 15.2–15.3.

Iijima, Akira, Japan Plastics Age News, Jun. 1963, pp. 32–34.

Mink, Walter, "Grundzuege der Extrudertechnik (1964), p. 300, (partial translation provided).

Hagen, Harro et al, "Polyaethylen und Andere Polyolefine", 1961, p. 252, (partial translation provided).

Mildner, R. C. et al, "The Electrical Characteristics of Some Resistive Plastics for the Wire and Cable Industry".

(List continued on next page.)

*Primary Examiner*—E. A. Goldberg
*Assistant Examiner*—M. M. Lateef
*Attorney, Agent, or Firm*—Timothy H. P. Richardson; Herbert G. Burkard

[57] ABSTRACT

In order to increase the stability of a device comprising at least one electrode and a conductive polymer composition in contact therewith, the contact resistance between the electrode and the composition should be reduced. This can be achieved by contacting the molten polymer composition with the electrode while the electrode is at a temperature above the melting point of the composition. Preferably, the polymer composition is melt-extruded over the electrode or electrodes, as for example when extruding the composition over a pair of pre-heated stranded wires.

13 Claims, No Drawings

OTHER PUBLICATIONS

Brochure entitled "NUC Polyethylene for Wires and Cables", published by Nitto Unicar Co. Ltd., (translation).

Brochure entitled "Extrusion Coating of Wires with Polyethylene by Nitto Unicar Co. Ltd.", published by Nitto Unicar Co. Ltd. (translation).

Dainichi-Nippon Cables Review (Nov. 1966), pp. 78-79.

Lectures on Electronics, vol. 6, pp. 202-203 (Apr. 1959).

"Defendant Thermon's Motion under Rule 15 for Leave to Amend Answer and Counterclaim".

"Carbon Black Differentiation by Electrical Resistance of Vulcanizates", by John E. McKinney/Frank L. Roth, Ind. & Engineering Chemistry, vol. 44, No. 1, pp. 159-163.

Encyclopedia of Polymer Science and Technology, vol. 8, pp. 533-535.

Eager et al., IEEE Trans. Power Apparatus and Systems, vol. PAS-88, 342-364, Apr. 1969.

Wire & Cable Coater's Handbook (du Pont Plastics Dept. 1968), pp. 4-7, 49 and 120-125.

Thermon's Answers & Objections to Raychem's First Set of Interrogatories, pp. 10-15.

McKelvey, James M., Polymer Processing; 1962, Chapters 6 and 14.

Amey, W. G. & Hamburger, F. A., Method for Evaluating the Surface & Volume Resistance Characteristics of Solid Dielectric Materials, *Proceedings ASTM,* vol. 49, p. 1979, (1949).

Field, R. F., Erros Occurring in the Measurement of Dielectric Constant, *Proceedings ASTM,* vol. 54, p. 456, (1954).

Murphy, E. J. & Morgan, S. O., The Dielectric Properties of Insulating Materials, Bell System Technical Journal, vol. 16, p. 493, (1937).

Thomson, B. H. & Mathes, K. N., Electrolytic Corrosion-Methods of Evaluating Materials Used in Tropical Service, *Transactions AIEE,* vol. 64, p. 287, (1945).

Dorcas, D. C. & Scott, R. N., Instrumentation for Measuring the D.C. Conductivity of Very High Resistivity Materials, Review of Scientific Instruments, vol. 34(9), p. 1175, (1964).

Cole, K. S. & Cole, R. H., Dispersion & Absorption in Dielectrics, II Direct Current Characteristics, *Journal of Chem. Phys.,* vol. 10, (1942).

Witt, R. K., Chapman, J. J., & Raskin, B. L., Measuring Surface and Volume Resistance, *Modern Plastics,* vol. 24, (8), p. 152, (1947).

Greenfield, E. W., Insulation Resistance Measurements, *Electrical Engineering,* vol. 66, p. 698, (1947).

La Flamme, P. M., Electrical Conductivity Cell for Organic Semiconductors, *Rev. of Sci. Inst.,* 35(9), p. 1193, (1964).

Pohl, H. A., Rembaum, A. & Henry, A., *Journal Am. Chem. Soc.,* 84, p. 2699, (1962).

Mildner, R. C., A Review of Resistive Compounds for Primary Urd Cables, *I.E.E.E. Transactions on Power Apparatus & Systems,* Feb. 1970, pp. 313-318.

Prudden, D. H., Wire Pre-Heating and Temperature Measurement, *Wire and Wire Products,* May 1970, pp. 67-73.

Brennan, D. P. & Lasko, R. J., In-Line Immersion Heating of Steel Wire, *Wire Journal,* Sep. 1973, pp. 110 to 115.

Hicks, A. E. & Lyon, F., Adhesion of Natural Rubber to Brassplated Wire, *Adhesives Age,* May 1959.

Johnson, Gordon P., Solid Polypropylene Insulation for Wire and Cable Applications, *Wire and Wire Products,* Mar. 1963.

Schenkel, Plastics Extrusion Technology, 1963 and 1966; p. 304.

ELECTRICAL DEVICES COMPRISING CONDUCTIVE POLYMER COMPOSITIONS

This application is a file wrapper continuation of copending Ser. No. 545,723, filed Oct. 26, 1983, now abandoned, which is a divisional of copending application Ser. No. 251,910, filed Mar. 27, 1979 (now U.S. Pat. No. 4,426,339), which is a continuation of application Ser. No. 24,369 filed Mar. 27, 1979, now abandoned, which is a continuation of application Ser. No. 750,149, filed Dec. 13, 1976, now abandoned. This application is also related to copending application Ser. No. 799,293, which is a file wrapper continuation of Ser. No. 545,724, filed Oct. 26, 1983, now abandoned. This application is also related to Ser. No. 656,625, filed Oct. 1, 1984, which is a continuation of Ser. No. 545,725, filed Oct. 26, 1983, now abandoned. This application is also related to Ser. No. 656,621, filed Oct. 1, 1984, which is a divisional of Ser. No. 545,725. Ser. Nos. 545,724 and 545,725 are continuations of Ser. No. 251,910.

BACKGROUND OF THE INVENTION

1. Field of the Invention

This invention relates to electrical devices in which an electrode is in contact with a conductive polymer composition.

2. Statement of the Prior Art

Conductive polymer compositions are well known. They comprise organic polymers having dispersed therein a finely divided conductive filler, for example carbon black or a particulate metal. Some such compositions exhibit so-called PTC (Positive Temperature Coefficient) behavior, i.e. they exhibit a rapid increase in electrical resistance over a particular temperature range. These conductive polymer compositions are useful in electrical devices in which the composition is in contact with an electrode, usually of metal. Devices of this kind are usually manufactured by methods comprising extruding or moulding the molten polymer composition around or against the electrode or electrodes. In the known methods, the electrode is not heated prior to contact with the polymer composition or is heated only to a limited extent, for example to a temperature well below the melting point of the composition. Well known examples of such devices are flexible strip heaters which comprise a generally ribbon-shaped core (i.e. a core whose cross-section is generally rectangular or dumbell-shaped) of the conductive polymer composition, a pair of longitudinally extending electrodes, generally of stranded wire, embedded in the core near the edges thereof, and an outer layer of a protective and insulating composition. Particularly useful heaters are those in which the composition exhibits PTC behavior, and which are therefore self-regulating. In the preparation of such heaters in which the composition contains less than 15% of carbon black, the prior art has taught that it is necessary, in order to obtain a sufficiently low resistivity, to anneal the heater for a time such that $$2L+5\log_{10}R\leqq 45$$

where L is the percent by weight of carbon and R is the resistivity in ohm.cm. For further details of known PTC compositions and devices comprising them, reference may be made to U.S. Pat. Nos. 2,978,665, 3,243,753, 3,412,358, 3,591,526, 3,793,716, 3,823,217, and 3,914,363, the disclosures of which are hereby incorporated by reference. For details of recent developments in this field, reference may be commonly assigned made to U.S. patent application Ser. Nos. 601,638 (now U.S. Pat. No. 4,177,376), 601,427 (now U.S. Pat. No. 4,017,715), 601,549 (now abandoned), and 601,344 (now U.S. Pat. No. 4,085,286) (all filed Aug. 4, 1975), 638,440 (now abandoned in favor of continuation-in-part application Ser. No. 775,882 issued as U.S. Pat. No. 4,177,446) and 638,687 (now abandoned in favor of continuation-in-part application Ser. No. 786,835 issued as U.S. Pat. No. 4,135,587) (both filed Dec. 8, 1975), the disclosures of which are hereby incorporated by reference.

A disadvantage which arises with devices of this type, and in particular with strip heaters, is that the longer they are in service, the higher is their resistance and the lower is their power output, particularly when they are subject to thermal cycling.

It is known that variations, from device to device, of the contact resistance between electrodes and carbon-black-filled rubbers is an obstacle to comparison of the electrical characteristics of such devices and to the accurage measurement of the resistivity of such rubbers, particularly at high resistivities and low voltages; and it has been suggested that the same is true of other conductive polymer compositions. Various methods have been suggested for reducing the contact resistance between carbon-black-filled rubbers and test electrodes placed in contact therewith. The preferred method is to vulcanise the rubber while it is in contact with a brass electrode. Other methods include copper-plating, vaccum-coating with gold, and the use of colloidal solutions of graphite between the electrode and the test piece. For details, reference should be made to Chapter 2 of "Conductive Rubbers and Plastics" by R. H. Norman, published by Applied Science Publishers (1970), from which it will be clear that the factors which govern the size of such contact resistance are not well understood. So far as we know, however, it has never been suggested that the size of the initial contact resistance is in any way connected with the changes in resistance which take place with time in devices which comprise an electrode in contact with a conductive polymer composition, e.g. strip heaters.

SUMMARY OF THE INVENTION

We have surprisingly discovered that the less is the initial contact resistance between the electrode and the conductive polymer composition, the smaller is the increase in total resistance with time. We have also found that by placing or maintaining the electrode and the polymer composition in contact with each other while both are at a temperature above the melting point of the composition, preferably at least 30° F., especially at least 100° F., above the melting point, the contact resistance between them is reduced. It is often preferable that the said temperature should be above the Ring-and-Ball softening temperature of the polymer. The term "melting point of the composition" is used herein to denote the temperature at which the composition begins to melt.

The preferred process of the invention comprises:

(1) heating a conductive polymer composition to a temperature above its melting point;

(2) heating an electrode, in the absence of the conductive polymer composition, to a temperature above the melting point of the conductive polymer composition;

(3) contacting the electrode, while it is at a temperature above the melting point of the polymer composition, with the molten polymer composition; and
(4) cooling the electrode and conductive polymer composition in contact therewith.

We have also found that for stranded wire electrodes, the contact resistance can be correlated with the force needed to pull the electrode out of the polymer composition. Accordingly the invention further provides a device comprising a stranded wire electrode embedded in a conductive polymer composition, the pull strength (P) of the electrode from the device being equal to at least 1.4 times $P_o$, where $P_o$ is the pull strength of an identical stranded wire electrode from a device which comprises the electrode embedded in an identical conductive polymer composition and which has been prepared by a process which comprises contacting the electrode, while it is at a temperature not greater than 75° F., with a molten conductive polymer composition. The pull strengths P and Po are determined as described in detail below.

We have also found that for strip heaters, currently the most widely used devices in which current is passed through conductive polymer compositions, the contact resistance can be correlated with the linearity ratio, a quantity which can readily be measured as described below. Accordingly the invention further provides a strip heater comprising:
(1) an elongate core of a conductive polymer composition;
(2) at least two longitudinally extending electrodes embedded in said composition parallel to each other; and
(3) an outer layer of a protective and insulating composition;

the linearity ratio between any pair of electrodes being at most 1.2, preferably at most 1.15, especially at most 1.10.

DESCRIPTION OF THE PREFERRED EMBODIMENTS OF THE INVENTION

The invention is useful with any type of electrode, for example plates, strips or wires, but particularly so with electrodes having an irregular surface, e.g. stranded wire electrodes as conventionally used in strip heaters, braided wire electrodes (for example as described in U.S. application Ser. No. 601,549, now abandoned) and expandable electrodes as described in U.S. application Ser. No. 638,440, now abandoned. Preferred stranded wires are silver-coated and nickel-coated copper wires, which can be pre-heated to the required temperatures without difficulties such as melting or oxidation, as may arise with tin-coated or uncoated copper wires.

The conductive polymer compositions used in this invention generally contain carbon black as the conductive filler. In many cases, it is preferred that the compositions should exhibit PTC characteristics. Such PTC compositions generally comprise carbon black dispersed in a crystalline polymer (i.e. a polymer having at least about 20% crystallinity as determined by X-ray diffraction). Suitable polymers include polyolefins such as low, medium and high density polyethylenes, polypropylene and poly(1-butene), polyvinylidene fluoride and copolymers of vinylidene fluoride and tetrafluoroethylene. Blends of polymers may be employed, and preferred crystalline polymers comprise a blend of polyethylene and an ethylene copolymer which is selected from ethylene/vinyl acetate copolymers and ethylene/ethyl acrylate copolymers, the polyethylene being the principal component by weight of the blend. The amount of carbon black may be less than 15% by weight, based on the weight of the composition, but is preferably at least 15%, particularly at least 17%, by weight. The resistivity of the composition is generally less than 50,000 ohm.cm at 70° F., for example 100 to 50,000 ohm.cm. For strip heaters designed to be powered by A.C. of 115 volts or more, the composition generally has a resistivity of 2,000 to 50,000 ohm.cm, e.g. 2,000 to 40,000 ohm.cm. The compositions are preferably thermoplastic at the time they are contacted with the electrodes, the term "thermoplastic" being used to include compositions which are lightly cross-linked, or which are in the process of being cross-linked, provided that they are sufficiently fluid under the contacting conditions to conform closely to the electrode surface.

As previously noted, the strip heaters of the invention preferably have a linearity ratio of at most 1.2, preferably at most 1.15, especially at most 1.10. The Linearity Ratio of a strip heater is defined as $$\frac{\text{Resistance at 30 mV.}}{\text{Resistance at 100 V.}}$$

the resistances being measured at 70° F. between two electrodes which are contacted by probes pushed through the outer jacket and the conductive polymeric core of the strip heater. The contact resistance is negligible at 100 V., so that the closer the Linearity Ratio is to 1, the lower the contact resistance. The Linearity Ratio is to some extent dependent upon the separation and cross-sections of the electrodes and the resistivity of the conductive polymeric composition, and to a limited extent upon the shape of the polymeric core. However, within the normal limits for these quantities in strip heaters, the dependence on them is not important for the purposes of the present invention. The linearity ratio is preferably substantially constant throughout the length of the heater. When it is not, the average linearity ratio must be less than 1.2 and preferably it is below 1.2 at all points along the length of the heater.

The strip heaters generally have two electrodes separated by a distance of 60 to 400 mils (0.15 to 1 cm), but greater separations, e.g. up to 1 inch (2.5 cm.) or even more, can be used. The core of conductive polymer can be of the conventional ribbon shape, but preferably it has a cross-section which is not more than 3 times, especially not more than 1.5 times, e.g. not more than 1.1 times, its smallest dimension, especially a round cross-section.

The strip heaters can be powered for example by a power source having a voltage of 120 volts AC.

As previously noted, we have found that for devices comprising stranded wire electrodes, the contact resistance can be correlated with the force needed to pull the electrode out of the polymer composition, an increase in pull strength reflecting a decrease in contact resistance. The pull strengths P and $P_o$ referred to above are determined at 70° F., as follows.

A 2 inch (5.1 cm) long sample of the heater strip (or other device), containing a straight 2 inch (5.1 cm) length of the wire, is cut off. At one end of the sample, one inch of the wire is stripped bare of polymer. The bared wire is passed downwardly through a hole slightly larger than the wire in a rigid metal plate fixed in the horizontal plane. The end of the bared electrode is firmly clamped in a movable clamp below the plate, and the other end of the sample is lightly clamped above the plate, so that the wire is vertical. The movable clamp is then moved vertically downwards at a speed of 2 inch/min. (5.1 cm/min.), and the peak force needed to pull the conductor out of the sample is measured.

When carrying out the preferred process of the invention, wherein the electrode and the polymer composition are heated separately before being contacted, it is preferred that the composition should be melt-extruded over the electrode, e.g. by extrusion around a wire electrode using a cross-head die. The electrode is generally heated to a temperature at least 30° F. above the melting point of the composition. The polymer composition will normally be at a temperature substantially above its melting point; the temperature of the electrode is preferably not more than 200° F. below, e.g. not more than 100° F. or 55° F. below, the temperature of the molten composition, and is preferably below, e.g. at least 20° F. below that temperature. The conductor should not, of course, be heated to a temperature at which it undergoes substantial oxidation or other degradation.

When the electrode and the composition are contacted while the electrode is at a temperature below the melting point of the composition and are then heated, while in contact with each other, to a temperature above the melting point of the composition, care is needed to ensure a useful reduction in the contact resistance. The optimum conditions will depend upon the electrode and the composition, but increased temperature and pressure help to achieve the desired result. Generally the electrode and composition should be heated together under pressure to a temperature at least 30° F., especially at least 100° F. above the melting point. The pressure may be applied in a press or by means of nip rollers. The time for which the electrode and the composition need be in contact with each other, at the temperature above the melting point of the composition, in order to achieve the desired result, is quite short. Times in excess of five minutes do not result in any substantial further reduction of contact resistance, and often times less than 1 minute are quite adequate and are therefore preferred. Thus the treatment time is of a quite different order from that required by the known annealing treatments to decrease the resistivity of the composition, as described for example in U.S. Pat. Nos. 3,823,217 and 3,914,363; and the treatment yields useful results even when the need for or desirability of an annealing treatment does not arise, as when the composition already has, without having been subjected to any annealing treatment or to an annealing treatment which leaves the resistivity at a level where $$2L+5\log_{10}R>45,$$

a sufficiently low resistivity, for example, by reason of a carbon black content greater than 15% by weight, e.g. greater than 17% or 20% by weight.

One way of heating the electrode and the composition surrounding it is to pass a high current through the electrode and thus produce the desired heat by resistance heating of the electrode.

Particularly when the conductive polymer composition exhibits PTC characteristics, it is often desirable that in the final product the composition should be cross-linked. Cross-linking can be carried out as a separate step after the treatment to reduce contact resistance; in this case, cross-linking with aid of radiation is preferred. Alternatively cross-linking can be carried out simultaneously with the said treatment, in which case chemical cross-linking with the aid of cross-linking initiators such as peroxides is preferred.

The invention is illustrated by the following Examples, some of which are comparative Examples.

In each of the Examples a strip heater was prepared as described below. The conductive polymer composition was obtained by blending a medium density polyethylene containing an antioxidant with a carbon black master batch comprising an ethylene/ethyl acrylate copolymer to give a composition containing the indicated percent by weight of carbon black. The composition was melt-extruded through a cross-head die having a circular orifice 0.14 inch (0.36 cm) in diameter over a pair of 22 AWG 19/34 silver-coated copper wires whose centers were on a diameter of the orifice and 0.08 inch (0.2 cm) apart. Before reaching the cross-head die, the wires were pre-heated by passing them through an oven 2 feet (60 cm) long at 800° C. The temperature of the wires entering the die was 180° F. in the comparative Examples, in which the speed of the wires through the oven and the die was 70 ft./min. (21 m/min), and 330° F. in the Examples of the invention, in which the speed was 50 ft./min. (15 m/min.)

The extrudate was then given an insulating jacket by melt-extruding around it a layer 0.02 inch (0.051 cm) thick of chlorinated polyethylene or an ethylene/tetrafluoroethylene copolymer. The coated extrudate was then irradiated in order to cross-link the conductive polymer composition.

EXAMPLES 1–3

These Examples, in which Example 1 is a comparative Example, demonstrate the influence of Linearity Ratio (LR) on Power Output when the heater is subjected to temperature changes. In each Example, the Linearity Ratio of the heater was measured and the heater was then connected to a 120 volt AC supply and the ambient temperature was changed continuously over a 3 minute cycle, being raised from −35° F. to 150° F. over a period of 90 seconds and then reduced to −35° F. again over the next 90 seconds.

The peak power output of the heater during each cycle was measured initially and at intervals and expressed as a proportion ($P_N$) of the initial peak power output.

The polymer composition used in Example 1 contained about 26% carbon black. The polymer composition used in Examples 2 and 3 contained about 22% carbon black.

The results obtained are shown in Table 1 below.

TABLE 1

| | *Example 1 | | Example 2 | | Example 3 | |
|---|---|---|---|---|---|---|
| No. of Cycles | $P_N$ | LR | $P_N$ | LR | $P_N$ | LR |
| None | 1 | 1.3 | 1 | 1.1 | 1 | 1 |
| 500 | 0.5 | 1.6 | 1.3 | — | 1 | 1 |
| 1100 | 0.3 | 2.1 | 1.2 | — | 1 | 1 |
| 1700 | — | — | 1.1 | 1.1 | 1 | 1 |

*Comparative Example

EXAMPLES 4–7

These Examples, which are summarised in Table 2 below, demonstrate the effect of pre-heating the electrodes on the Linearity Ratio and Pull Strength of the product.

TABLE 2

| Example No. | % Carbon Black | Linearity Ratio |
|---|---|---|
| *4 | 22 | 1.6 |
| 5 | 22 | 1.0 |
| *6 | 23 | 1.35 |
| 7 | 23 | 1.1 |

*Comparative Example

The ratio of the pull strengths of the heater strips of Examples 7 and 6 ($P/P_o$) was 1.45.

I claim:

1. A self-regulating strip heater comprising (1) an elongate core of a melt-extruded electrically conductive polymer composition which (a) has a resistivity at 70° F. of 100 to 50,000 ohm.cm, (b) comprises an organic thermoplastic polymer and conductive carbon black dispersed therein, and (c) exhibits PTC characteristics;

(2) two longitudinally extending electrodes which are embedded in and surrounded by said elongate core parallel to each other, and which are in direct physical and electrical contact with the conductive polymer composition; and (3) an elongate layer of a protective and insulating composition which surrounds said elongate core and electrodes and is in direct physical contact with said elongate core;

the average linearity ratio between the electrodes being at most 1.2; and the heater having been prepared by a process which comprises (i) melt-extruding a molten thermoplastic electrically conductive polymer composition over and into direct physical and electrical contact with the electrodes, thus forming an elongate core of the melt-extruded conductive polymer composition having two longitudinally extending electrodes embedded therein parallel to each other; the conductive polymer composition comprising an organic thermoplastic polymer and conductive carbon black dispersed therein, and being such that when it is melt-extruded in this way, it does not need a subsequent annealing treatment at a temperature above the crystalline melting point of the polymer in order to have a resistivity at 70° F. of less than 50,000 ohm.cm; and (ii) cooling the whole of the melt-extruded conductive polymer composition to a temperature below its melting point, the cooled composition having a resistivity at 70° F. of 100 to 500,000 ohm.cm and exhibiting PTC characteristics; and (iii) forming the elongate layer around and in direct physical contact with the elongate core;

without subjecting the heater, at any stage after the whole of the melt-extruded conductive polymer composition has cooled to a temperature below its melting point, to a heat treatment in which substantially all of the cooled conductive polymer composition is reheated above the crystalline melting point of the organic polymer.

2. A heater according to claim 1 wherein the conductive polymer composition contains at least 15% by weight of carbon black.

3. A heater according to claim 1 wherein the conductive polymer compositions contains at least 17% by weight of carbon black.

4. A heater according to claim 1 wherein the average linearity ratio between the electrodes is at most 1.10.

5. A heater according to claim 1 which comprises two stranded wire electrodes separated by a distance of up to 1 inch.

6. A heater according to claim 5 wherein the conductive polymer composition in the core has a resistivity at 70° F. of 2,000 to 40,000 ohm.cm.

7. A heater according to claim 6 whose linearity ratio is substantially constant along the length of the heater.

8. A heater according to claim 1 wherein the conductive polymer composition is cross-linked.

9. A heater according to claim 1 wherein the conductive polymer composition comprises carbon black dispersed in a crystalline polymer which comprises a blend of polyethylene and an ethylene copolymer selected from ethylene/vinyl acetate copolymers and ethylene/ethyl acrylate copolymers, the polyethylene being the principal component of the blend by weight.

10. A heater according to claim 1 wherein the electrically conductive polymer composition comprises a polymer which has at least about 20% crystallinity as determined by x-ray diffraction and which is selected from the group consisting of polyolefins, polyvinylidene fluoride and copolymers of vinylidene fluoride and tetrafluoroethylene.

11. A heater according to claim 1 which has been prepared by a process in which the heater is not subjected, at any stage after the whole of the melt-extruded conductive polymer composition has cooled to a temperature below its melting point, to a heat treatment in which any of the cooled conductive polymer is reheated above the crystalline melting point of the organic polymer.

12. A heater according to claim 1 which contains up to 15% by weight of carbon black.

13. A heater according to claim 1 which contains 15 to 17% by weight of carbon black.

* * * * *

UNITED STATES PATENT AND TRADEMARK OFFICE

CERTIFICATE OF CORRECTION

PATENT NO. : 4,764,664

DATED : August 16, 1988

INVENTOR(S): Hundi P. Kamath, et al.

It is certified that error appears in the above-identified patent and that said Letters Patent are hereby corrected as shown below:

| | |
|---|---|
| Title page, left hand column, "Related U.S. Application Data", lines 2 to 3 | After "Ser. No. 251,910," replace "Mar. 27, 1979" by --Apr. 7, 1981--. |
| Title page, left hand column, "U.S. Patent Documents", line 18 | Replace "Vlgenderen" by --Van Vlaenderen" |
| Title page, right hand column, "Foreign Patent Documents", after line 13 | Add --1516874 7/1978 United Kingdom--. |
| Title page, right hand column, "Other Publications", line 2 (Griff) | Replace "pp. 197, 198 of 208" by --pp. 192-233--. |
| Page 2, right hand column, "Other Publications", line 37 (Schenkel) | Replace "p. 304" by --pp. 301-318--. |

UNITED STATES PATENT AND TRADEMARK OFFICE

CERTIFICATE OF CORRECTION

PATENT NO. : 4,764,664

DATED : August 16, 1988

INVENTOR(S): Hundi P. Kamath, et al.

It is certified that error appears in the above-identified patent and that said Letters Patent are hereby corrected as shown below:

Page 2, right hand column, "Other Publications", after line 37, add the following:

--Meyer I, Polymer Engineering & Science, Oct. 1974, pp. 706-716.--.

--Meyer II, Polymer Engineering & Science, Nov. 1973, pp. 462-468.--.

--Boonstra et al., Industrial & Engineering Science, Jan. 1954, pp. 218-227.--.

--Norman, Conductive Rubbers and Plastics, pp. 7-29.--.

--Wire, by Tarbox, Oct. 1961, pp. 1385-7 and 1460-1.--.

--Rubber Age, by Griesser et al., June 1955, pp.391-8.--.

-"Plastics Materials", by J.A. Brydson, pp. 194, 197-200 (1975).--.

--"Extrusion of Plastics", by E.G. Fisher, pp.200-234 (1958).--.

UNITED STATES PATENT AND TRADEMARK OFFICE

CERTIFICATE OF CORRECTION

PATENT NO. : 4,~~8~~7 64,664

DATED : August 16, 1988

INVENTOR(S): Hundi P. Kamath, et al.

It is certified that error appears in the above-identified patent and that said Letters Patent are hereby corrected as shown below:

| | |
|---|---|
| Column 1, line 8 | Replace "Mar. 27, 1979" by --Apr. 7, 1981--. |
| Column 1, line 44 | After "composition" insert --, for example not more than 150°F as in conventional wire-coating techniques--. |
| Column 2, line 1 | Delete "commonly assigned". |
| Column 2, line 2 | After "to" insert --commonly assigned--. |
| Column 2, line 23 | Replace "accurage" by --accurate--. |
| Column 3, line 20 | Replace "Po" by --$P_o$--. |
| Column 7, line 12 | Replace "I" by --We--. |
| Column 7, line 53 (Claim 1, line 40) | Replace "500,000" by --50,000--. |

UNITED STATES PATENT AND TRADEMARK OFFICE

CERTIFICATE OF CORRECTION

PATENT NO. : 4,~~8~~7 64,664

DATED : August 16, 1988

INVENTOR(S) : Hundi P. Kamath, et al

It is certified that error appears in the above-identified patent and that said Letters Patent is hereby corrected as shown below:

| | |
|---|---|
| Column 8, line 14<br>(Claim 3, line 2) | Replace "compositions" by<br>--composition--. |

Signed and Sealed this

Seventh Day of March, 1989

*Attest:*

*Attesting Officer*

DONALD J. QUIGG

*Commissioner of Patents and Trademarks*